US010082055B2

(12) United States Patent
Watanabe

(10) Patent No.: US 10,082,055 B2
(45) Date of Patent: Sep. 25, 2018

(54) VALVE TIMING CONTROL DEVICE FOR INTERNAL COMBUSTION ENGINE

(71) Applicant: HITACHI AUTOMOTIVE SYSTEMS, LTD., Hitachinaka-shi, Ibaraki (JP)

(72) Inventor: Kotaro Watanabe, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 182 days.

(21) Appl. No.: 15/032,400

(22) PCT Filed: Nov. 11, 2014

(86) PCT No.: PCT/JP2014/079800
§ 371 (c)(1),
(2) Date: Apr. 27, 2016

(87) PCT Pub. No.: WO2015/087649
PCT Pub. Date: Jun. 18, 2015

(65) Prior Publication Data

US 2016/0273417 A1 Sep. 22, 2016

(30) Foreign Application Priority Data

Dec. 11, 2013 (JP) ..... 2013-255530

(51) Int. Cl.
*F01L 1/34* (2006.01)
*F01L 1/344* (2006.01)
(Continued)

(52) U.S. Cl.
CPC ..... *F01L 1/3442* (2013.01); *B21K 1/22* (2013.01); *F02D 13/0203* (2013.01);
(Continued)

(58) Field of Classification Search
CPC ..... F01L 1/3442; F01L 2001/34479; F01L 2001/34456; F01L 2001/34423;
(Continued)

(56) References Cited

U.S. PATENT DOCUMENTS 5,295,390 A 3/1994 Hosono
5,584,267 A 12/1996 Muir
(Continued)

FOREIGN PATENT DOCUMENTS

| | | | |
|---|---|---|---|
| JP | S53-030468 | A | 3/1978 |
| JP | S62-168615 | A | 7/1987 |
| JP | 03-106518 | A | 5/1991 |
| JP | 04-033728 | A | 2/1992 |
| JP | 09-189210 | A | 7/1997 |
| JP | 10-225729 | A | 8/1998 |
| JP | 10-331614 | A | 12/1998 |
| JP | 2000-240414 | A | 9/2000 |
| JP | 2003-088055 | A | 3/2003 |
| JP | 2003-262107 | A | 9/2003 |
(Continued)

*Primary Examiner* — Zelalem Eshete
(74) *Attorney, Agent, or Firm* — Foley & Lardner LLP

(57) ABSTRACT

A front plate for a valve timing control device is produced which comprises a plate part that closes a front opening of a housing body to seal operation oil chambers in the housing body and a cylindrical part that is integral with and projected forward from an opened central portion of the plate part and after production of the front plate, an annular part of a front surface of the plate part near a root portion of the cylindrical part is pressed, by a press machine, toward a rear surface of the plate part against a supporting tool that intimately supports the rear surface of the plate part, so that the rear surface of the plate part has an improved flatness at an annular area surrounding the opening of the front plate thereby to increase a sealability between the plate part and the front opening of the housing body.

13 Claims, 9 Drawing Sheets

(51) Int. Cl.
*B21K 1/22* (2006.01)
*F02D 13/02* (2006.01)

(52) U.S. Cl.
CPC ..... *F01L 2001/3443* (2013.01); *F01L 2001/34423* (2013.01); *F01L 2001/34456* (2013.01); *F01L 2001/34469* (2013.01); *F01L 2001/34479* (2013.01); *F01L 2001/34483* (2013.01); *F01L 2103/00* (2013.01); *F02D 13/0219* (2013.01)

(58) Field of Classification Search
CPC ..... F01L 2001/34483; F01L 2103/00; F02D 13/0203; F02D 13/0219; B21K 1/22
See application file for complete search history.

(56) References Cited

U.S. PATENT DOCUMENTS

| | | | | |
|---|---|---|---|---|
| 2001/0022164 | A1* | 9/2001 | Ogawa ..... | F01L 1/3442 123/90.16 |
| 2003/0168032 | A1 | 9/2003 | Miyazaka et al. | |
| 2012/0160196 | A1 | 6/2012 | Sakane | |

FOREIGN PATENT DOCUMENTS

| | | | |
|---|---|---|---|
| JP | 2012-000668 | A | 1/2012 |
| JP | 2012-132404 | A | 7/2012 |

* cited by examiner

VALVE TIMING CONTROL DEVICE FOR INTERNAL COMBUSTION ENGINE

TECHNICAL FIELD

The present invention relates to a valve timing control device for an internal combustion engine, which varies and controls the open/close timing of intake or exhaust valves in accordance with a vehicle operation condition.

BACKGROUND ART

One known valve timing control device for an internal combustion engine is described in the after-mentioned Patent Document-1.

The known device will be briefly described in the following. The device comprises a housing member that receives a torque from a crankshaft and has therein a plurality of operation oil chambers extending around an inner cylindrical surface of the housing, a front plate that includes a plate part closing at its rear surface a front open part of the housing member and a cylindrical part formed on a central portion of a front surface (outer end surface) of the plate part, a vane rotor that is received in the housing member and rotatable in a given range in both the most delayed angle side and most advanced angle side relative to the housing member and has four vanes for grouping the operation oil chambers into delayed angle operation oil chambers and advanced angle operation oil chambers, and a torsion spring that is partially received in the cylindrical part of the front plate and has one end engaged to a front edge of the cylindrical part and the other end engaged to the vane rotor.

The torsion spring is arranged to bias the vane rotor in the advanced angle side by its biasing force, and by controlling the open/close timing of the exhaust valves in the advanced angle side for improving the engine startability.

PRIOR ART DOCUMENTS

Patent Documents

Patent Document-1: Japanese Laid-open Patent Application (tokkai) 2012-132404

SUMMARY OF INVENTION

Problems to be Solved by Invention

In the known valve timing control devices such as one mentioned hereinabove, the front open part of the housing member is dosed by the rear surface of the plate part of the front plate for sealing the plurality of operation oil chambers. However, it is difficult to sufficiently increase the accuracy of a side clearance between the rear surface of the plate part of the front plate and a counterface surface of the vane rotor that axially faces the rear surface of the plate part.

That is, when the front plate with the cylindrical part is formed entirely by press-forming, shaping the cylindrical part by applying a burring press to a central portion of the plate part inevitably brings about production of so-called sagging between a base part of the cylindrical part and the central portion of the plate part. With such sagging, a central portion of the rear surface of the plate part is rippled or bent, which may cause deterioration in accuracy of the side clearance and increase leakage of the operation oil from the operation oil chambers.

The present invention is provided by taking the drawback of the known valve timing control devices into consideration and provides a valve timing control device for an internal combustion engine, which is constructed to have a high sealing accuracy by increasing a surface area of a circular central part of the rear surface of the plate part of the front plate.

Means for Solving the Problems

The invention defined by claim 1 is a valve timing control device for an internal combustion engine, which comprises a housing body to which a torque is transmitted from a crankshaft, at least one of axial ends of the housing body being opened; a vane rotor that includes a rotor fixed to the camshaft, a plurality of vanes provided on the rotor, the vanes being operatively engageable with a plurality of shoes projected from an inner cylindrical surface of the housing body thereby to constitute delayed angle operation chambers and advanced angle operation chambers, the vane rotor being selectively rotated in a delayed angle side or an advanced angle side relative to the housing body in response to charging or discharging of an operation oil to or from the delayed and advanced angle operation chambers; a front plate including a discal plate part that closes the axial open end of the housing body at its rear surface thereby sealing all of the delayed and advanced angle operation chambers and a cylindrical part that is integrally projected outward from a peripheral edge of a through opening formed in a central portion of the discal plate part; and a torsion spring that has one end engaged to the rotor and the other end engaged to the cylindrical part thereby to constantly bias the vane rotor in one of opposed rotation directions relative to the housing body, the valve timing control device being characterized in that an annular part of a front surface of the plate part near a root portion of the cylindrical part is pressed toward the rear surface of the plate part to produce a recess and during the pressing, an inner area of the rear surface of the plate part, which is placed at a position corresponding to the position where the recess is produced, is supported against the pressing force, so that the annular area and an inner cylindrical surface of the cylindrical part are shaped to have a generally right angled cross section.

Effects of Invention

According to the invention, the sealing accuracy of the rear surface of the plate part can be increased by increasing a surface area of the circular central part of the rear surface of the plate part by suppressing production of the sagging at the circular central part of the rear surface of the plate part. As a result, undesired leakage of the operation oil from the operation oil chambers can be suppressed.

EMBODIMENTS FOR CARRYING OUT INVENTION

In the following, an embodiment of the valve timing control device for an internal combustion engine according to the present invention will be described in detail with reference to the accompanying drawings. In the illustrated embodiment, there is employed a type in which the control device is applied to a valve actuating device for exhaust valves.

First Embodiment

Figure 1:
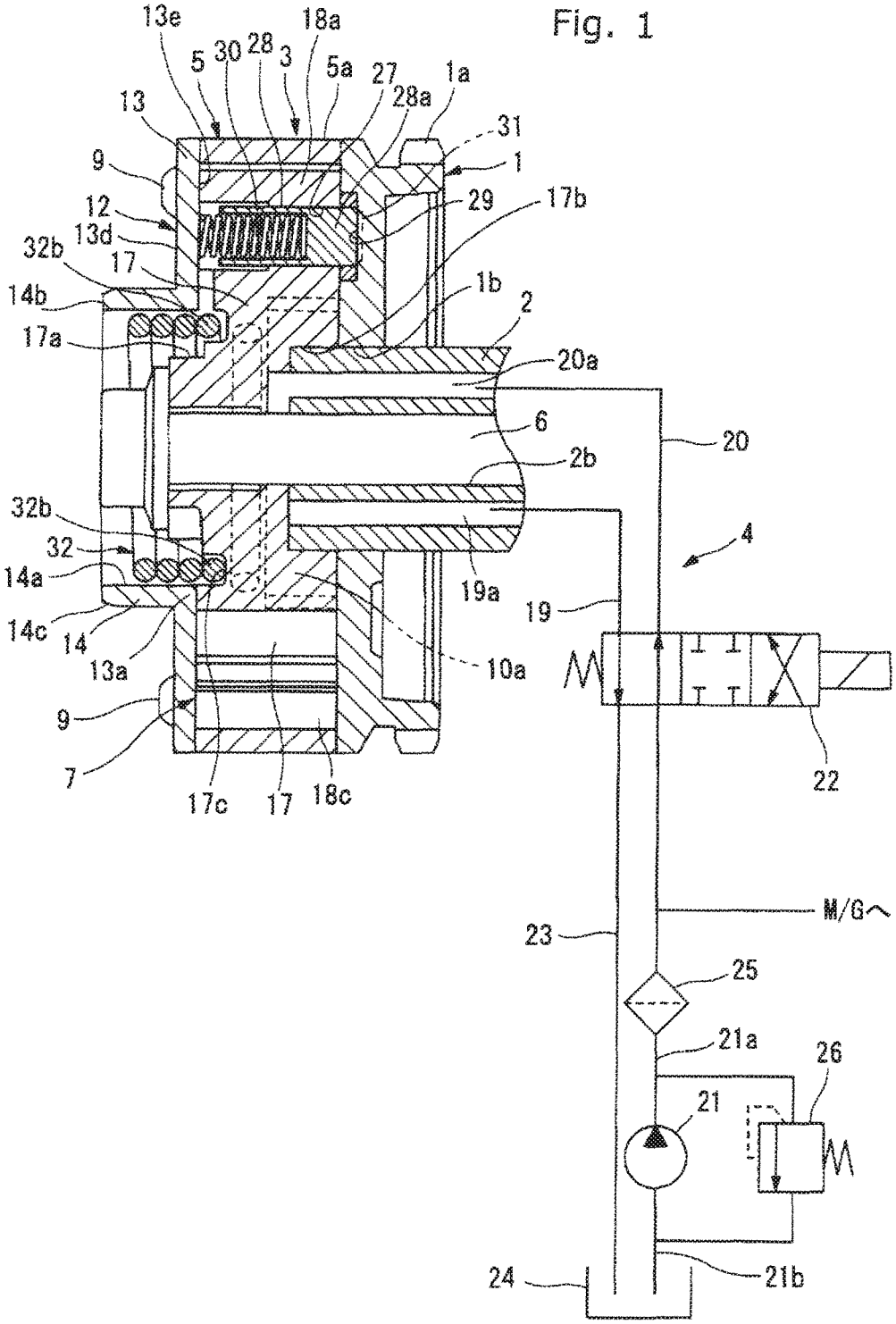
FIG. 1 is a partially sectioned entire construction view of a valve timing control device of the present invention.
Figure 2:
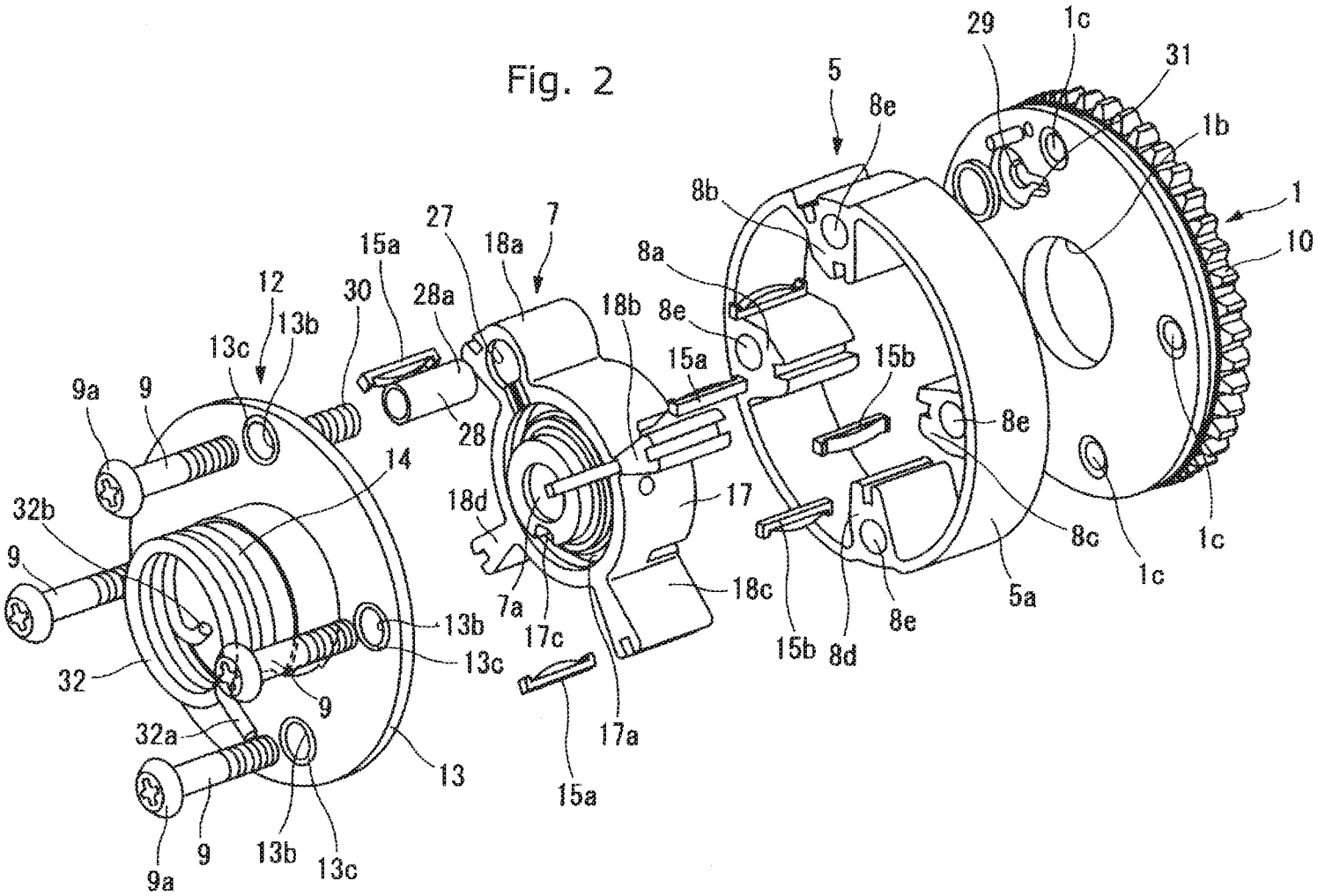
FIG. 2 is an exploded perspective view of the valve timing control device that is an embodiment of the present invention.

As is seen from FIGS. 1 and 2, the valve timing control device (VTC) for an internal combustion engine comprises a sprocket 1 that is a drive rotation member driven by a crankshaft (not shown) through a timing chain, a camshaft 2 that is arranged to make a rotation relative to the sprocket 1, a phase varying mechanism 3 that is arranged between the sprocket 1 and the camshaft 2 to vary a relative rotation phase between them 1 and 2 and a hydraulic circuit 4 that actuates the phase varying mechanism 3.

The sprocket 1 is made of an iron-based metal and shaped like a thicker disc, and has on a periphery thereof a gear portion 1*a* around which the above-mentioned timing chain is wound, and has at a central portion thereof a supporting opening 1*b* through which an outer cylindrical surface of the camshaft 2 is rotatably supported. Furthermore, the sprocket 1 is formed at four equally spaced radially outer portions thereof with respective internally threaded openings 1*c* to which after-mentioned four bolts 9 are engaged. The sprocket 1 can serve as a rear cover that closes a rear opening of an after-mentioned housing 5.

The camshaft 2 is rotatably supported by a cylinder head (not shown) through camshaft bearings and integrally formed at given axial portions thereof with egg-shaped cams for making open/close operation of the exhaust valves, and the camshaft 2 is formed at one axial end 2*a* thereof with a bolt inserting hole 2*b* into which a shaft portion 6*a* of a cam bolt 6 is inserted in an axial direction to fix an after-mentioned vane rotor 7 to the camshaft 2. A leading end of the bolt inserting hole 2*b* is formed with an internal thread (not shown) to which an external thread formed on a leading end of the cam bolt 6 is engaged.

Figure 3:
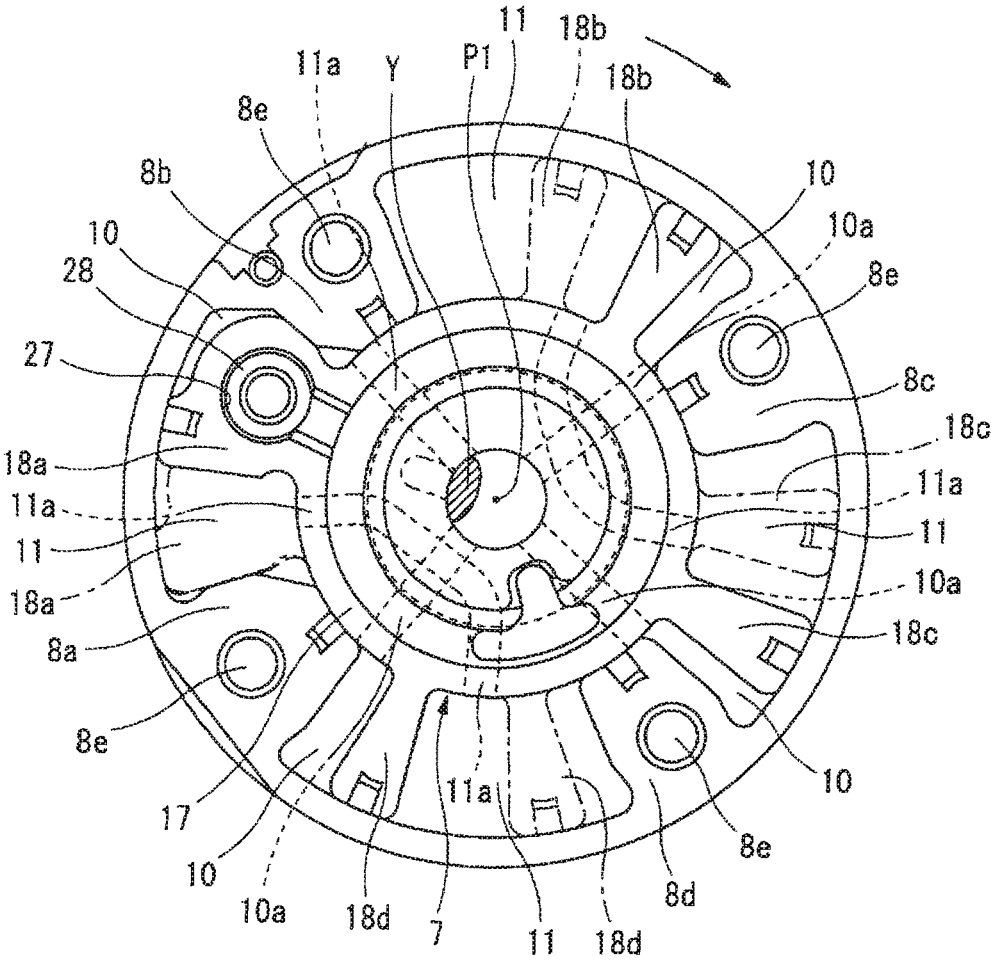
FIG. 3 is a front view showing a vane rotor and its associated parts with a front plate removed.

As is seen from FIGS. 1 to 3, the phase varying mechanism 3 comprises a housing 5 that has therein operation oil chambers, a vane rotor 7 that is a driven rotation member fixed to one end of the cam shaft 2 through the cam bolt 6 and swingably rotatably received in the housing 5, and four delayed angle hydraulic chambers 10 or the delayed angle operation oil chambers and four advanced angle hydraulic chambers 11 or the advanced angle operation oil chambers that are each defined between each of four (first to fourth) shoes 8*a* to 8*d* integrally formed on an cylindrical inner surface of an after-mentioned cylindrical housing body 5*a*.

The housing 5 comprises the cylindrical housing body 5*a* that is made of a sintered metal, a front plate 12 that closes a front opening of the housing body 5*a*, and the sprocket 1 that closes a rear opening of the housing body 5*a* to serve as a rear cover. The housing body 5*a*, the front plate 12 and the sprocket 1 are tightly joined together by the four bolts 9 that pass through bolt openings 8*e* respectively formed in the shoes 8*a* to 8*d*.

The front plate 12 is integrally produced by pressing a carbon steel plate with a press machine and a specialized press method, and as is seen from FIGS. 1, 2 and 4 to 6, comprises a circular plate part 13 and a cylindrical part 14 integrally formed on a central part of the circular plate part 13 via the press-forming.

The plate part 13 is formed at a central part thereof with a relatively large through opening 13*a* that forms a part of the cylindrical part 14, and to a hole edge of the through opening 13*a* provided at a front surface 13*d*, there is integrally connected the cylindrical part 14. That is, the cylindrical part 14 is projected forward from a rear surface side 13*e* of the plate part 13 while being bent, and an inner diameter of the through opening 13*a* is the same as that of an inner cylindrical surface 14*a* of the cylindrical part 14, and the through opening 13*a* and the cylindrical part 13 are coaxially and continuously connected.

The plate part 13 is formed at equally spaced four peripheral portions thereof with respective bolt openings 13*b* through which the bolts 9 pass, and each bolt opening 13*b* is formed, at a hole edge thereof on the front surface 13*d*, with a tapered annular recess with which a base part of the shaft of the bolt 9 is engaged. Furthermore, around the tapered annular recess of each bolt opening, there is formed an annular seat surface 13*c* onto which a rear surface of a head 9*a* of the bolt 9 is seated.

The cylindrical part 14 is projected forward from the front surface 13*d* of the plate part 13 by a given distance, and a leading end 14*b* of the cylindrical part 14 has a tapered surface 14*c* the vertical section of which is circular-arc in shape, and the cylindrical part 14 is provided with a circular-arc shaped cut 14*d* at a position that corresponds to a position taken by an after-mentioned widest first vane 18*a* when it is turned in a circumferential direction within a given range. The cylindrical part 14 is further provided at a circumferentially opposed end of the cut 14*d* with a first spring engaging groove 14*e* that is an engaging portion.

Figure 4:
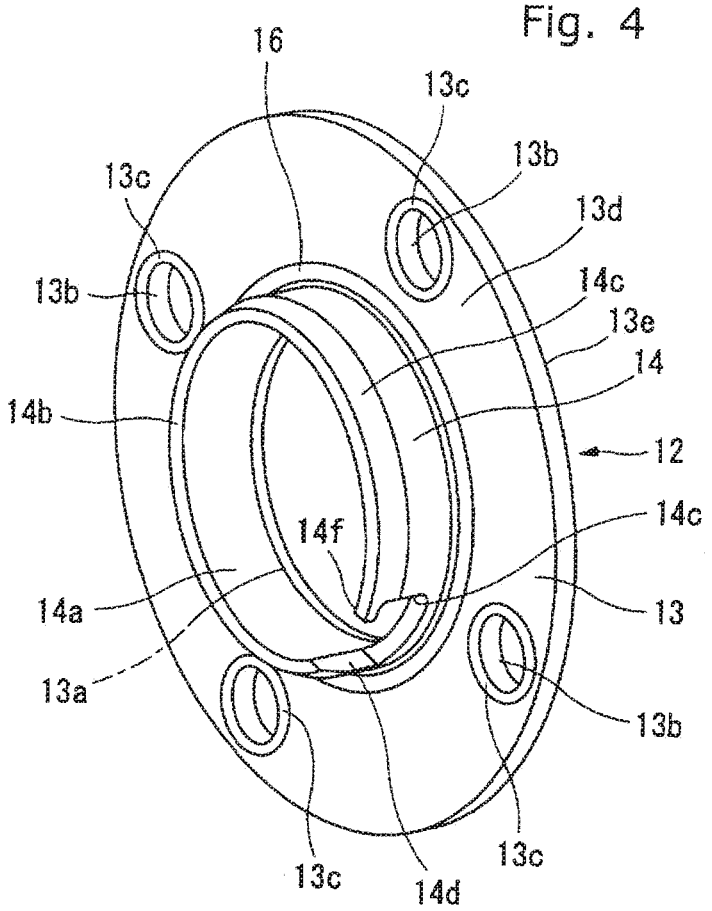
FIG. 4 is a perspective view of the front plate employed in the embodiment.
Figure 5:
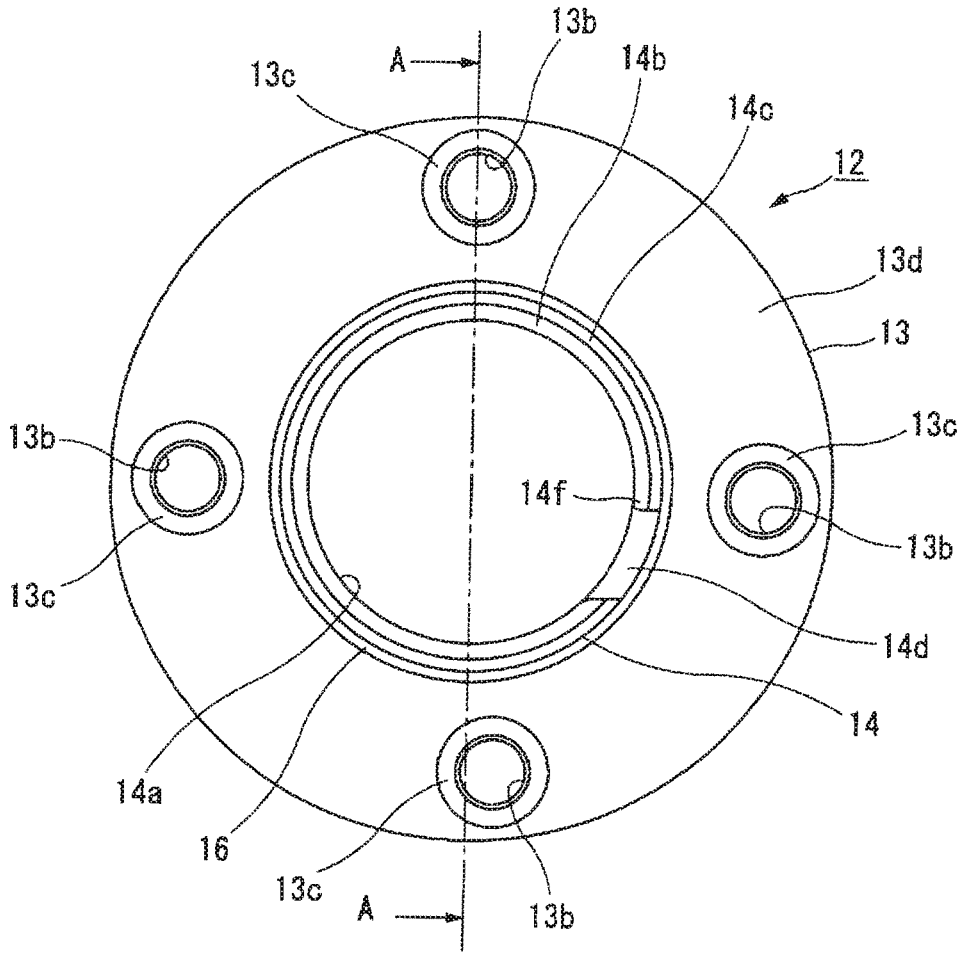
FIG. 5 is a front view of the front plate.
Figure 9:
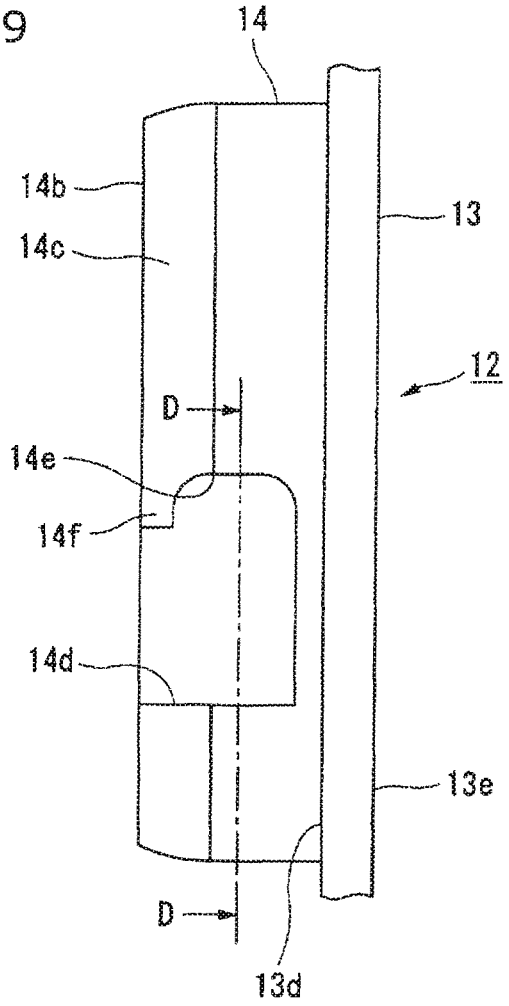
FIG. 9 is a side view of a cylindrical part of the front plate employed in the embodiment.

As is seen from FIGS. 4 and 9, the first spring engaging groove 14*e* is shaped nearly rectangular, and the groove 14*e* extends inward, while curving, from a projection 14*f* formed on a front end 14*b* of the cylindrical part 14, and extends linearly from one end of the curved part, and extends, while curving, from one end of the linear part. The first spring engaging groove 14*e* is a groove to which a first engaging end 32*a* of an after-mentioned torsion spring 32 is engaged from a circumferential direction, and the projection 14*f* functions to prevent disengagement of the first engaging end 32*a* of the torsion spring 32 from a front part of the engaging groove 14*e*.

Figure 10:
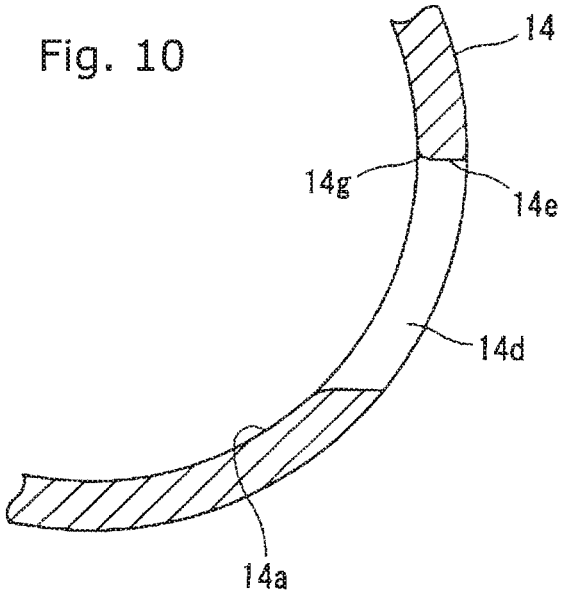
FIG. 10 is a sectional view taken along the line D-D of FIG. 9.

As is seen from FIG. 10, the first spring engaging groove 14*e* has, at one inside edge of the inner cylindrical surface of the cylindrical part 14, that is, at the inside edge to which the first engaging end 32*a* is engaged, a convex surface 14*g*.

Figure 6:
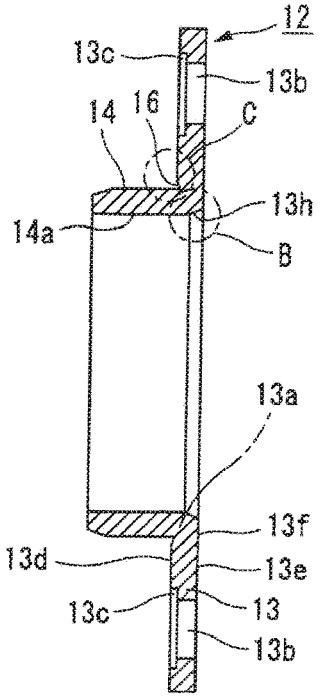
FIG. 6 is a sectional view taken along the line A-A of FIG. 5.
Figure 7:
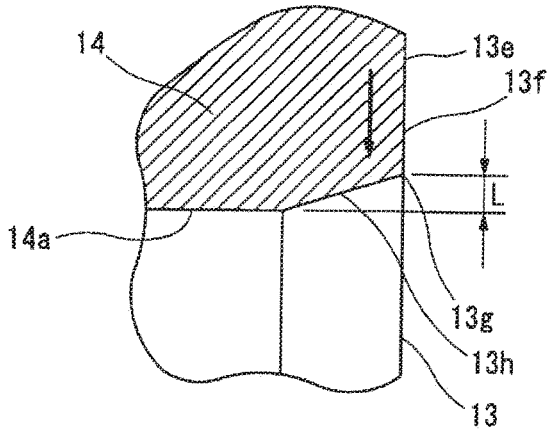
FIG. 7 is an enlarged view of the part indicated by index line B of FIG. 6.
Figure 8:
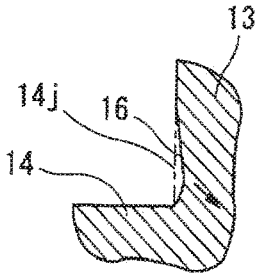
FIG. 8 is an enlarged view of the part indicated by index line C of FIG. 6.

As is seen from FIGS. 6 to 8, the connecting portion between the plate part 13 and cylindrical part 14 has a unique structure. This unique structure is produced through an after-mentioned press forming.

That is, by pressing a root portion of the cylindrical part 14 relative to the plate part 13 toward the rear surface side 13*e* by an after-mentioned pressing punch, there is produced an annular recess 16 around an annular area of the front surface 13*d* of the plate part 13. During this pressing, the rear surface 13*e* of the plate part 13 is entirely supported by an after-mentioned cylindrical supporting tool 41 against the pressing force.

With the above-mentioned process, an annular area 13*f* of the rear surface 13*e* is pressed or shifted toward the axis of cylindrical part 14 (viz., in the direction of the arrow of FIG. 7), so that the annular area 13*f* is shaped to have a right angled cross section increasing its outer surface area while sufficiently reducing the length L between a hole edge 13*g* of the annular area 13*f* and the inner cylindrical surface 14*a* of the cylindrical part 14. Accordingly, a tapered annular surface 13*h* produced between the hole edge 13*g* of the annular area 13*f* and the inner cylindrical surface 14*a* of the cylindrical part 14 has a sufficiently small taper angle.

Although the above-mentioned annular recess 16 is of an endless type provided around the outer surface of the root of the cylindrical part 14, the annular recess 16 is not always necessary to extend entirely around the root. That is, the annular recess 16 may have a cut portion or cut portions in the entire length.

The vane rotor 7 is integrally constructed of for example a sintered metal, and as is seen from FIGS. 1 to 3, comprises a rotor 17 that is connected to the camshaft 2 by the cam bolt 6 inserted through a bolt inserting bore 7*a* formed in an axially middle portion of the rotor, and four, that is, first to fourth vanes 18*a* to 18*d* that are radially outwardly projected from equally spaced portions (viz., spaced by 90 degrees) of an outer cylindrical wall of the rotor 17.

The rotor 17 is shaped generally cylindrical and has at a radially outer part of a front surface of the rotor an annular groove 17*a* and at a rear surface of the rotor a circular engaging bore 17*b* to which a leading end 2*b* of the camshaft 2 is tightly engaged. An inner surface of the annular groove 17*b* is formed with a second spring engaging groove 17*c* that extends (radially) toward the axis of the bolt inserting bore 7*a*.

As is seen from FIG. 1, the rotor 17 has, at the side directed toward the camshaft 2, an axially rear surface that slidably contacts with an opposing front surface of the sprocket 1 leaving a minute clearance therebetween. While, an axially front surface of the rotor slidably contacts with an opposing rear surface 13*e* of the plate part 13 of the front plate 12 leaving a minute clearance therebetween, so that the rotor establishes a sealing function against both the front surface of the sprocket 1 and the rear surface 13*e* of the plate part 13.

While, as is seen from FIGS. 2 and 3, the first to fourth vanes 18*a* to 18*d* are each put between adjacent two of the shoes 8*a* to 8*d*, and the vanes are each provided at a rounded outer wall thereof with a groove for holding a sealing member 15*a* that slidably contacts the inner cylindrical surface of the housing body 5*a* while establishing sealing therebetween. While, the shoes 8*a* to 8*d* are each provided at a top surface thereof with a groove to hold a sealing member 15*b* that slidably contacts an outer cylindrical surface of the rotor 17 while establishing sealing therebetween. Each of the vanes 18*a* to 18*d* has opposed end surfaces in the width direction thereof (viz., axial direction of a rotor shaft) which slidably and respectively contact the front surface of the sprocket 1 and the rear surface 13*e* of the plate part 13 leaving a minute clearance therebetween, so that the vanes establish a sealing against both the front surface of the sprocket 1 and the rear surface 13*e* of the plate part 13.

The first vane 18*a* in the vanes 18*a* to 18*d* is shaped like a fan with a largest width when viewed from the side and has the largest weight, and the three vanes 18*b* to 18*d* other than the first vane 18*a* have each a width smaller than that of the first vane 18*a*. Because the first vane 18*a* is largest in weight, the center Y of gravity (viz., the oval illustrated by hatched line) of the vane rotor 7 is placed at a position shifted toward the first vane 18*a* from the center point P1.

As will be understood from the dot-dash line of FIG. 3, when the vane rotor 7 is rotated in the most delayed angle direction, one side surface of the first vane 18*a* is moved in a circumferential direction and finally brought into contact with an opposing surface of the first shoe 8*a* thereby to limit the rotational position of the vane rotor in the most delayed angle side. Furthermore, as will be understood from the solid line, when the vane rotor is rotated in the most advanced angle direction, the other side surface of the first vane 18*a* is moved in a circumferential direction and finally brought into contact with an opposing surface of the second shoe 8*b* thereby to limit the rotational position of the vane rotor in the most advanced angle side. Thus, the first vane 18*a* and the first and second shoes 8*a* and 8*b* thus constitute a stopper that limits both the most delayed and most advanced angles positions of the vane rotor 7.

During the above-mentioned movement of the vane rotor, the second to fourth vanes 18*b* to 18*d* are kept away from their opposing surfaces of the shoes 8*c* and 8*d* without contacting the same. Accordingly, a so-called contact accuracy between the first vane 18*a* and each of the first and second shoes 8*a* and 8*b* is increased and since the speed in feeding the hydraulic pressure to the delayed and advanced angle hydraulic chambers 10 and 11 is increased, the rotation responsiveness of the vane rotor 7 in normal and reverse directions is increased.

The delayed angle hydraulic chambers 10 and the advanced angle hydraulic chambers 11 are respectively connected to the hydraulic circuit 4 through first and second connecting holes 10*a* and 11*a* that extend in the rotor 17 in radial direction.

The hydraulic circuit 4 is a circuit that selectively feeds or discharges the hydraulic oil to or from the delayed and advanced angle hydraulic chambers 10 and 11, and as is seen from FIG. 1, the hydraulic circuit 4 comprises a delayed angle oil passage 19 that feeds and discharges the hydraulic pressure to and from each of the delayed angle hydraulic chambers 10 through the first connecting hole 10*a*, an advanced angle oil passage 20 that feeds and discharges the hydraulic pressure to and from each of the advanced angle hydraulic chambers 11 through the second connecting hole 11*a*, and an oil pump 21 that feeds the hydraulic pressure to the oil passages 19 and 20 and an electromagnetic switch valve 22 that switches the flow of the delayed and advanced angle oil passages 19 and 20 in accordance with an operation condition of the engine. The oil pump 21 is of a common type, such as a trochoid pump or the like which is rotated or driven by the crankshaft of an engine.

The delayed angle oil passage 19 and the advanced angle oil passage 20 have respective ends connected to passage ports of the electromagnetic switch valve 22, and the other ends of the passages 19 and 20 are connected through a cylinder head (not shown) and a cylinder block (not shown) to an interior of the camshaft 2 constituting delayed and advanced angle passage portions 19*a* and 20*a* that extend axially in parallel with each other.

The delayed angle passage portion 19*a* is connected to the delayed angle hydraulic chambers 10 through the first connecting holes 10*a*, and the advanced angle passage portion 20*a* is connected to the advanced angle hydraulic chambers 11 through the connecting holes 11*a*.

As is seen from FIG. 1, the electromagnetic switch valve 22 is of a type having two positions and three ports and so constructed that upon control by an electronic controller (not shown), a spool valve (not shown) slidably movably arranged in a valve body is moved in a forward or rearward direction to connect a discharge passage 21*a* of the oil pump 21 to one of the oil passages 19 and 20 and simultaneously connect the other oil passage 19 or 20 to a drain passage 23.

An intake passage 21*b* of the oil pump 21 and the drain passage 23 are connected to interior of an oil pan 24. The discharge passage 21*a* of the oil pump 21 has at its downstream portion a filtration filter 25 and is connected at the downstream portion to a main oil gallery M/G that feeds the oil to mutually sliding and contacting portions of the internal combustion engine. The oil pump 21 is equipped with a flow rate control valve 26 that controls the oil discharged from the discharge passage 21*a* to a suitable amount by discharging an excessive part of the oil to the oil pan 24.

The electronic controller is equipped with a computer which, by receiving information signals from a crank angle sensor (not shown), an air flow meter, an engine cooling water temperature sensor, a throttle valve open degree sensor, and a cam angle sensor that detects a current rotation phase of the camshaft, estimates the current operation condition of the engine, and by outputting a control pulse signal to an electromagnetic coil of the electromagnetic switch valve 22, controls the shift position of a spool valve of the electromagnetic switch valve 22 thereby to carry out a desired switching of the above-mentioned passages.

Between the first vane 18*a* and a rear cover 1*b* of the sprocket 1, there is arranged a lock mechanism that is able to lock the vane rotor 7 at the most advanced angle position relative to the housing 5.

As is seen from FIGS. 1 to 3, the lock mechanism comprises a lock pin 28 that is slidably received in a hole 27 formed in and extending axially in the first vane 18*a* and is projectable toward the rear cover 1*b*, a lock opening 29 that is formed in a radially middle portion of the rear cover 1*b* and engageable with a leading end 28*a* of the lock pin 28 to lock the vane rotor 7, and an engaging/disengaging mechanism that engages or disengages the leading end 28*a* of the lock pin 28 to or from the lock opening 29.

The lock pin 28 with the leading end 28*a* is entirely shaped cylindrical so that engagement of the lock pin 28 with the lock opening 29 in the axial direction is easily made, and a coil spring 30 is provided and compressed between a bottom of an axially extending bore formed in the lock pin 28 and the rear surface 13*e* of the front plate 12 for biasing the lock pin 28 in a projecting direction (viz., the direction for establishing the engagement).

The lock opening 29 is sized larger in diameter than the leading end portion of the lock pin 28 and placed at a position circumferentially eccentric toward the advanced angle hydraulic chamber 11, so that upon engagement with the lock pin 28, a relative converting angle between the housing 5 and the vane rotor 7 takes a value that corresponds to the most advanced angle position. At a side portion of the lock opening 29, that is, at a position that is one stage lower than the position of the lock opening 29, there is formed a circular-arc shaped pressure receiving chamber 31 that is smaller in diameter than the lock pin 28.

The engaging/disengaging mechanism comprises the above-mentioned coil spring 30 that biases the lock pin 28 in the projecting direction, and a disengagement hydraulic circuit (not shown) that feeds the pressure receiving chamber 31 with a hydraulic pressure to move back the lock pin 28. In the disengagement hydraulic circuit, there is arranged a system by which the hydraulic pressure selectively fed to the delayed and advanced angle hydraulic chambers 10 and 11 is led to the pressure receiving chamber 31 through given oil holes for moving or biasing the lock pin 28 in a backward direction.

Within a space defined by the plate part 13, the cylindrical part 14 and the annular groove 17*a* of the rotor 17, there is installed a torsion spring 32 that biases the vane rotor 7 in a timing advancing direction relative to the housing 5.

As is seen from FIGS. 1 and 2, the torsion spring 32 comprises a coiled spring body part, a first engaging end portion 32*a* that extends radially outward from one end of the spring body part and a second engaging end portion 32*b* that extends radially inward from the other end of the spring body part.

The coiled spring body part is almost entirely received in the through opening 13*a* and the cylindrical part 14, and an axially inside part of the spring body part is received and arranged in the annular groove 17*a* of the rotor 17.

The second engaging end portion 32*b* is engaged to the first spring engaging groove 14*e* from a circumferential direction and the second engaging end portion 32*b* is engaged and fixed to the second spring engaging groove 17*c* of the rotor 17 from an axial direction. Due to the spring force of the torsion spring 32, the vane rotor 7 is constantly biased to rotate in a timing advancing direction.

The torsion spring 32 is constructed to reduce its diameter when the vane rotor 7 is turned in a timing delaying direction relative to the housing 5.

[Method for Producing the Front Plate]

The front plate 12 is produced by carrying out a series of press forming steps depicted by FIGS. 11A to 11F.

Figure 11:
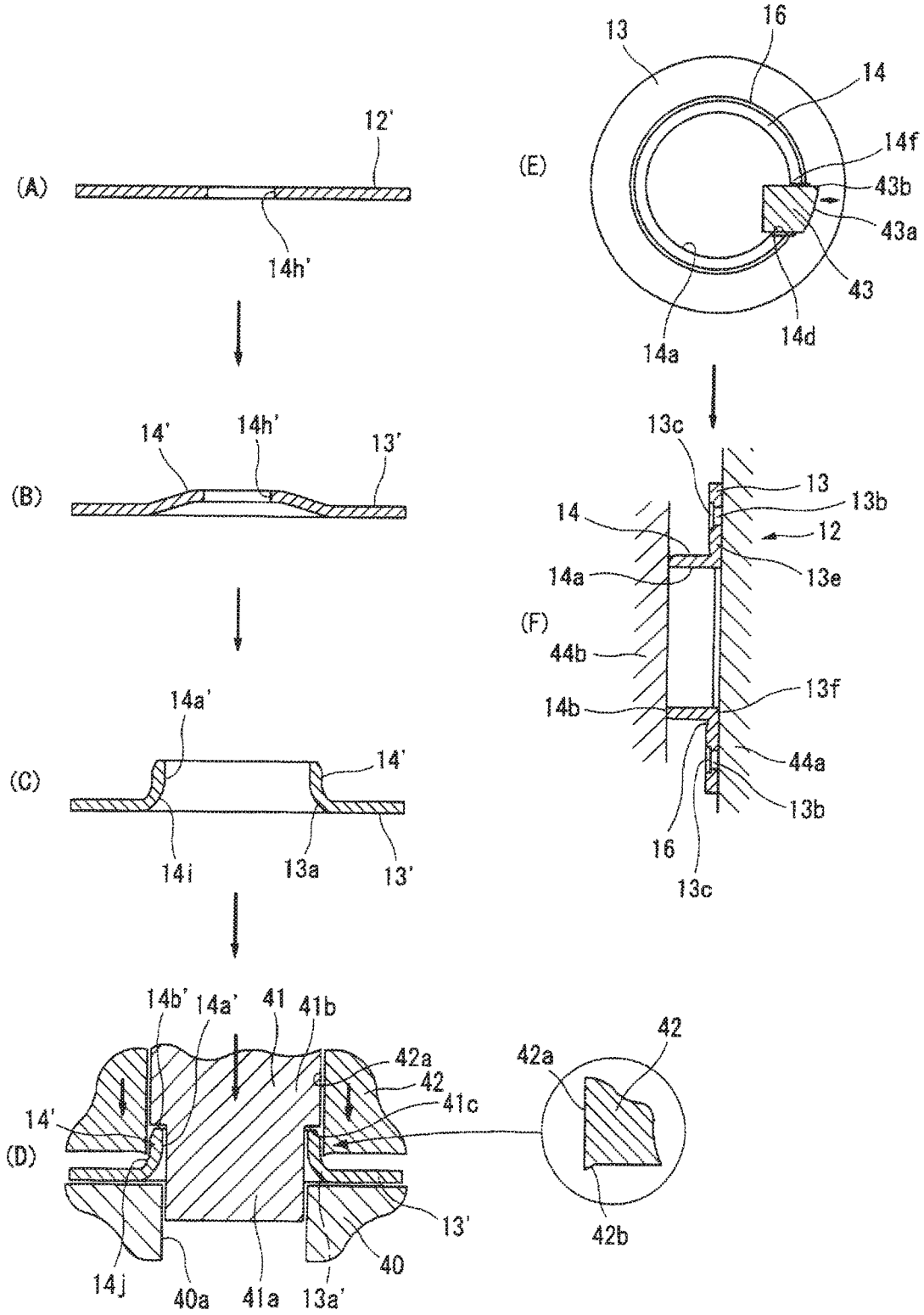
FIG. 11 is a schematic illustration showing steps A to F for forming the front plate used in the embodiment.

First, as is seen from FIG. 11A, a carbon steel base metal 12' for the front plate 12 is shaped into a circular plate by a press machine (not shown). The circular plate thus provided has at its central portion a cylindrical part forming opening 14*h'* that is used for forming a cylindrical part 14'.

Then, as is seen from FIGS. 11B and 11C, an annular portion of the circular plate that surrounds the cylindrical part forming opening 14*h'* is gradually pressed upward to produce an integral unit that includes a plate part 13' and a cylindrical part 14' (Burring Method). Due to this pressing step, an inner cylindrical part 14*i* of a junction portion (or root portion) between the plate body 13' and the cylindrical part 14' inevitably brings about production of so-called sagging.

Then, as will be understood from FIG. 11D, the base metal 12' for the front plate 12 thus formed is set on and fitted to a mounting base 40 that has at a position corresponding to the cylindrical part 14' an inserting hole 40*a*, and a supporting tool 41 is inserted into the cylindrical part 14' from above. The supporting tool 41 is shaped like a stepped cylindrical member and has a smaller diameter leading end portion 41*a* having an outer diameter smaller than an inner diameter of an inner cylindrical surface 14*a'* of the cylindrical part 14' and, upon insertion of the supporting tool, the leading end portion 41*a* of the tool is placed closely to the inner cylindrical surface 14*a'*. Under this condition, a stepped part 41*c* defined between larger and smaller diameter portions 41*b* and 41*a* of the supporting tool 41 is arranged to axially face a leading end surface 14*b*' of the cylindrical part 14' keeping a minute clearance therebetween.

Then, with the above-mentioned condition being kept, by using a press punch 42 arranged around the supporting tool 41, an outer cylindrical wall 14*j* of the root of the cylindrical part 14' is pressed downward as is indicated by the arrows. As is seen from the drawing provided at a right side of FIG. 11D, a center bore 42*a* of the press punch 42 has, around its lower edge, a sharply sloped annular press edge part 42*b*, and when the outer cylindrical wall 14*j* is pressed down by the press edge part 42*b* in the direction of the arrows, the plate part 13 produces the above-mentioned annular recess 16 around the inner cylindrical part thereof.

That is, when the pressing force for forming the annular recess 16 is applied to the given portion, the inner cylindrical portion of the plate part 13' and the root area part of the cylindrical part 14' are pressed radially inward. During this pressing, the inner cylindrical surface 14*a*' of the root portion of the cylindrical part 14' and an inner cylindrical surface of the plate part 13' near a through opening 13*a*' are intimately supported by an outer cylindrical surface of the supporting tool 41 and an upper surface of the mounting base 40 near the inserting hole 40*a* against the pressing force.

Accordingly, the material of the plate part 13 placed around the through opening 13*a*' is shifted in the direction of the arrow of FIG. 8, that is, toward the axis of the cylindrical part 14, so that as is seen from FIG. 7, the annular area 13*f* of the rear surface side 13*e* of the plate part is shifted toward the axis of the cylindrical part 14. With such shifting, the annular area 13*f* of the rear surface side 13*e* of the plate part 13 is shaped to have a right-angled cross section increasing the inner surface area thereof. Thus, the above-mentioned undesired sagging caused by the initial pressing is eliminated.

Then, as is seen from FIG. 11E, a punch 43 is hitted radially outward (in the direction of the arrow) against a given portion of the cylindrical part 14 from inside, and thus, as is seen from FIG. 10, there are produced the above-mentioned cut 14*d* and the first spring engaging groove 14*e*. The punch 43 has a convex front end surface 43*a* radius of curvature of which is almost the same as that of the cylindrical part 14, and during the punching, an upper edge 43*b* of the front end surface 43*a* moves radially outward from the side of axis of the cylindrical part 14 (viz., from the inside) for forming the first spring engaging groove 14*e* by punching. With such movement, the above-mentioned arc surface 14*g* is formed at the inside edge as is shown in FIG. 10.

Then, the base metal 12' for the front plate 12 is subjected to a heat treatment at a given temperature for a give time, and then, as is seen from FIG. 11F, a hole punching process is applied to equally spaced portions of the peripheral part of the plate part 13 for forming four bolt openings 13*b* at the peripheral part. Then, by using a coining process, each bolt opening 13*b* has at an outer edge part thereof the above-mentioned annular seat surface 13*c*.

Then, the rear surface 13*e* of the plate part 13 and the leading end surface 14*b* of the cylindrical part 14 are put between front and rear polishing devices 44*a* and 44*b* to carry out a so-called double disc polishing. With this polishing, the rear surface 13*e* can have a high surface roughness for increasing a side clearance accuracy between it and the above-mentioned roller 17.

With the above-mentioned steps, a series of forming work for forming the front plate 12 is completed.

[Operation Effects of the Valve Timing Control Device of the Embodiment]

As is seen from FIG. 3, at the time of starting the engine, the vane rotor 7 is biased toward the most advanced angle position by the spring force of the torsion spring 32 and the leading end 28*a* of the lock pin 28 is engaged with the lock opening 29 retaining the vane rotor 7 at an advanced angle position that is optimal for effecting the engine starting. Accordingly, the valve timing of the exhaust valves is stably controlled to the most advanced angle side. Thus, when an engine starting is carried out due to ON-switching of the ignition switch, a satisfied engine startabillity is exhibited.

When, after the engine starting, the engine is operated in a low speed load range, de-energization of the electromagnetic coil of the electromagnetic switching valve 22 is kept by the electronic controller. With this, connection between an exhaust passage 18*a* of the oil pump 21 and the delayed angle oil passage 19 is established and connection between the advanced angle oil passage 20 and the drain passage 23 is established.

Thus, the operation oil discharged from the oil pump 21 is led into the delayed angle hydraulic chambers 10 through the delayed angle oil passage 19 causing the delayed angle hydraulic chambers 10 to show a higher pressure, and at the same time, the operation oil in the advanced angle hydraulic chambers 11 is led into the oil pan 22 through the advanced angle oil passage 20 and the drain passage 23 causing the advanced angle hydraulic chambers 11 to show a lower pressure.

At this time, the operation oil led into the delayed angle hydraulic chambers 10 is led into both the pressure receiving chamber 31 and the lock opening 29 through the above-mentioned disengagement hydraulic circuit thereby causing the chamber 31 and the lock opening 29 to have a higher pressure, and thus, the lock pin 28 is moved back to disengage the leading end 28*a* from the lock opening 29 resulting in a free rotation of the vane rotor 7.

Accordingly, in accordance with increase of the volume of the delayed angle hydraulic chambers 10, the vane rotator 7 is turned left in the drawing (viz., in the delayed angle direction) as is indicated by a dot-dash line in FIG. 3, so that one side surface of the first vane 18*a* is brought into contact with an opposing surface of the first shoe 8*a* thereby to restrain the vane rotor 7 at the most advanced rotation angle position. With this, the vane rotor 7 or the chamber shaft 2 changes its rotation angel relative to the housing 5 in the delayed angle toward the most delayed angle side.

Due to rotation of the vane rotor 7 in the delayed angle side relative to the housing 5, the torsion spring 32 is deformed in a diameter reducing direction.

When, then, the engine operation is shifted for example to a high rotation load range, a control current is outputted to the electromagnetic switch valve 22 from the electronic controller, so that the discharge passage 21*a* is connected to the advanced angle oil passage 20 and at the same time the delayed angle oil passage 19 is connected to the drain passage 23. With such connection, the operation oil in the delayed angle hydraulic chambers 10 is discharged thereby to cause the chambers 10 to show a lower pressure, and the operation oil is led into the advanced angle hydraulic chambers 11 thereby to cause the chambers 11 to show a higher pressure. During this, due to the flow of the operation oil from the advanced angle hydraulic chambers 11 to the pressure receiving chamber 31 through the above-mentioned disengagement hydraulic circuit, the lock pin 28 is disengaged from the lock opening 29 and keeps the disengaged condition.

Accordingly, as is indicated by the solid line in FIG. 3, the vane rotor 7 is turned toward the advanced angle side relative to the housing 5, so that the other side surface of the first vane 18*a* is brought into contact with an opposing surface of the second shoe 8*b* thereby to retain the vane rotor 7 at the most advanced angle rotation side. With this, the camshaft 2 is shifted in rotation timing to the most advanced angle side relative to the housing 5. As a result, the open/close timing of the exhaust valves is controlled to the most advanced angle side, and thus, the output of the engine in the high rotation high load range can be improved.

At a time just before stopping the engine, the operation oil in the hydraulic chambers 10 and 11 is discharged to the oil pan 22 through the drain passage 23, and thus, the hydraulic pressure in both the pressure receiving chamber 29 and the lock opening 29 is lowered too. Thus, due to the spring force of the torsion spring 32*a* applied to the camshaft 2, the vane rotor 7 is turned toward the most advanced angle side and due to spring force of the coil spring 30, the lock pin 28 is projected causing its leading end 28*a* to engaged with the lock opening 29.

Since a relative positioning in a circumferential direction of the housing between the lock pin 28 and the lock opening 29 is assuredly made at the time of assembling the parts, the engagement of the lock pin 28 with the lock opening 29 is smoothly achieved.

Furthermore, since, in the embodiment, the front plate 12 is integrally produced by pressing a relatively thin iron-based metal plate via press forming, a light-weight production of the front plate is assuredly possible and the work for manufacturing the front plate is simple, which can bring about a cost reduction.

Furthermore, in the embodiment, for formation of the annular recess 16 on the inner cylindrical part of the front surface 13*d* of the plate part 13, the root portion of the cylindrical part 14 is pressed by the press punch 42, so that the annular area 13*f* of the rear surface 13*e* is shaped to have a right angled cross section increasing its inner outer surface area. With this feature, the sagging is eliminated and thus a sealing surface can be increased, and thus, the sealing accuracy of the side clearance between the plate part and the axially other end surface of the rotor 17 can be sufficiently increased.

Since enlargement of the outer surface area of the annular area 13*f* of the rear surface 13*e* is carried out by co-operation work between the press punch 42 and the supporting tool 41 not by abrasive machining, the forming cost can be reduced.

Furthermore, since the inside edge of the first spring engaging groove 14*e* is shaped to have the arc surface 14*g*, damages that would appear on the outer surface of the first engaging end portion 32*a* of the torsion spring 32 when the first engaging end portion 32*a* is kept engaged with the first spring engaging groove 14*e* can be eliminated.

Furthermore, because of provision of the tapered to annular surface 13*h* between the inside hole edge 13*g* of the annular area 13*f* and the inner cylindrical surface 14*a* of the cylindrical part 14, the deformation of the torsion spring 32 in a diameter expanding direction can be neatly received by a space defined by the tapered annular surface 13*h*, and thus, a smoothed deformation of the torsion spring 32 is achieved. Furthermore, due to provision of the space, interference of the outer surface of the torsion spring 32 with the inner cylindrical surface 14*a* of the cylindrical part 14 is suppressed and thus, damages of the outer surface of the torsion spring and generation of noises can be suppressed.

Furthermore, since the annular seat surface 13*c* of the plate part 13 is formed also by the press forming, cost can be reduced as compared with that in the abrasive machining.

Furthermore, in the embodiment, due to provision of the widest first vane 18*a* of the vane rotor 7, the center of gravity of the vane rotor is offset to the side of the first vane 18*a*, and at the same time due to provision of the cut 14*d* and the first spring engaging groove 14*e* of the cylindrical part 14, the center of gravity of the front plate 12 is offset to one side that is opposite to the other side where the cut 14*d* and the first spring engaging groove 14*e* are provided, and thus, an excessive weight caused by the first vane 18*a* is cancelled.

Accordingly, a weight balancing in entire construction of the valve timing control device is sufficiently achieved without providing the third vane 18*c* with a balancing weight or the like that is positioned opposite to the position where the first vane 18*a* is provided, and due to provision of the cut 14*d* and the first spring engaging groove 14*e*, light weighting of the device is obtained.

It is to be noted that the present invention is not limited to the construction of the above-mentioned embodiment. That is, the construction is changeable within the concept of the invention.

The invention claimed is:

1. A valve timing control device for an internal combustion engine, comprising:

a housing body to which torque is transmitted from a crankshaft, at least one of axial ends of the housing body being opened;

a vane rotor that includes a rotor fixed to a camshaft, a plurality of vanes provided on the rotor, the vanes being operatively engageable with a plurality of shoes projected from an inner cylindrical surface of the housing body to thereby define delayed angle operation chambers and advanced angle operation chambers, the vane rotor being selectively rotated in a delayed angle side or an advanced angle side relative to the housing body in response to charging or discharging of operation oil to or from the delayed and advanced angle operation chambers;

a front plate including a discal plate part structured to close the at least one axial open end of the housing body at a rear surface of the plate part, thereby sealing all of the delayed and advanced angle operation chambers, and a cylindrical part that is integrally projected outward from a peripheral edge of a through opening formed in a central portion of the discal plate part; and a torsion spring that has one end engaged to the rotor and another end engaged to the cylindrical part thereby to constantly bias the vane rotor in one of opposed rotation directions relative to the housing body, wherein the plate part has, on a front surface thereof, around a root portion of the cylindrical part, a recess that is produced when a corresponding portion of the plate part is pressed in a direction from the front surface to the rear surface.

2. The valve timing control device for an internal combustion engine as claimed in claim 1, wherein an inner cylindrical surface of the through opening of the plate part is formed with a tapered surface that inclines downward from the rear surface of the plate part toward the cylindrical part.

3. The valve timing control device for an internal combustion engine as claimed in claim 2, wherein the recess is produced through press forming.

4. The valve timing control device for an internal combustion engine as claimed in claim 3, wherein the recess is an annular recess that extends around the root portion of the cylindrical part.

5. The valve timing control device for an internal combustion engine as claimed in claim 3, wherein the plate part and the cylindrical part of the front plate are integrally produced through the press forming, and, during pressing to form the recess, a portion of the rear surface of the plate part that corresponds to the recess is supported to form the tapered surface.

6. The valve timing control device for an internal combustion engine as claimed in claim 2, wherein the cylindrical part is formed with a cut that extends axially from a leading end of the cylindrical part by a given length, and the cut is formed at its depth facing the plate part with a circularly extending cut that serves as an engaging portion to which the one end of the torsion spring is engaged.

7. The valve timing control device for an internal combustion engine as claimed in claim 6, wherein peripheral edges of the cut and the engaging portion are each shaped to have an arc-shaped cross section.

8. The valve timing control device for an internal combustion engine as claimed in claim 1, wherein a peripheral outer portion of the plate part includes a plurality of bolt openings through which bolts pass to fix the plate part to the housing body, and the bolt openings are each formed, at an edge thereof on the front surface of the plate part, with a seat surface on which a head part of each bolt is seated.

9. A method of producing a valve timing control device for an internal combustion engine, the valve timing control device including a housing body to which torque is transmitted from a crankshaft, at least one of axial ends of the housing body being opened;

a vane rotor that includes a rotor fixed to the camshaft, a plurality of vanes provided on the rotor, the vanes being operatively engageable with a plurality of shoes projected from an inner cylindrical surface of the housing body to thereby define delayed angle operation chambers and advanced angle operation chambers, the vane rotor being selectively rotated in a delayed angle side or an advanced angle side relative to the housing body in response to charging or discharging of operation oil to or from the delayed and advanced angle operation chambers;

a front plate including a discal plate part structured to close the at least one axial open end of the housing body at a rear surface of the plate part, thereby sealing all of the delayed and advanced angle operation chambers, and a cylindrical part that is integrally projected outward from a peripheral edge of a through opening formed in a central portion of the discal plate part; and a torsion spring that has one end engaged to the rotor and another end engaged to the cylindrical part to thereby constantly bias the vane rotor in one of opposed rotation directions relative to the housing body, the method comprising:

fitting the plate part onto a press base;

inserting and setting a cylindrical supporting tool into and in the cylindrical part, the cylindrical supporting tool having an internal form mated with an inner cylindrical surface of the cylindrical part; and pressing, via a punch, a part of the front surface of the plate part proximate to an inner cylindrical part of a root portion of the cylindrical part toward the rear surface to produce a recessed portion on the front surface, and simultaneously supporting, by the supporting tool, an inner cylindrical portion of the cylindrical part, which corresponds to the recessed portion of the front surface, against a pressing force of the punch, thereby expanding the inner cylindrical part toward the through opening and increasing a surface area of the inner cylindrical part.

10. The method of producing a valve timing control device for an internal combustion engine as claimed in claim 9, comprising:

forming the cylindrical part with a cut that extends axially from a leading end of the cylindrical part by a given length, wherein the cut is formed at its depth facing the plate part with a circularly extending cut that serves as an engaging portion to which the one end of the torsion spring is engaged.

11. The method of producing a valve timing control device for an internal combustion engine as claimed in claim 10, comprising:

producing the cut and the engaging portion through a punching process in which a punch of a press forming machine is pressed radially outward from an interior of the cylindrical part, wherein the punching process comprises shaping the cut and the engaging portion to each have an arc-shaped cross section.

12. The method of producing a valve timing control device for an internal combustion engine as claimed in claim 9, comprising:

polishing the rear surface of the plate part and a leading end surface of the cylindrical part from an axial direction at the same time.

13. The method of producing a valve timing control device for an internal combustion engine as claimed in claim 9, comprising:

forming radially outer and circumferentially spaced portions of the plate part with bolt holes through which bolts pass to fix the plate part to the housing body, and forming each of the bolt holes at a hole edge thereof with a seat surface on which a head portion of each bolt is seated, the seat surface being produced through a coining process.

* * * * *